US010714256B2

(12) United States Patent
Bergsblom et al.

(10) Patent No.: US 10,714,256 B2
(45) Date of Patent: Jul. 14, 2020

(54) ELECTRICAL DEVICE COMPRISING A GAS-INSULATED APPARATUS, IN PARTICULAR A GAS-INSULATED TRANSFORMER OR REACTOR

(71) Applicant: ABB Power Grids Switzerland AG, Baden (CH)

(72) Inventors: Malena Bergsblom, Enköping (SE); Manoj Pradhan, Bålsta (SE); Roberto Zannol, Montegrotto Terme (IT); Santanu Singha, Västerås (SE); Stephan Schnez, Zürich (CH); Thorsten Steinmetz, Baden-Dättwil (CH); Venkatesulu Bandapalle, Västerås (SE)

(73) Assignee: ABB Power Grids Switzerland AG, Baden (CH)

( * ) Notice: Subject to any disclaimer, the term of this patent is extended or adjusted under 35 U.S.C. 154(b) by 818 days.

(21) Appl. No.: 15/402,775

(22) Filed: Jan. 10, 2017

(65) Prior Publication Data

US 2017/0148563 A1 May 25, 2017

Related U.S. Application Data

(63) Continuation of application No. PCT/EP2014/064869, filed on Jul. 10, 2014.

(51) Int. Cl.
*H01F 27/32* (2006.01)
*H01F 27/18* (2006.01)
(Continued)

(52) U.S. Cl.
CPC ..... *H01F 27/321* (2013.01); *H01F 27/18* (2013.01); *H01F 27/20* (2013.01); *H01F 27/40* (2013.01); *H01F 27/42* (2013.01)

(58) Field of Classification Search
CPC ..... H01F 27/321; H01F 27/40; H01F 27/20; H01F 27/18; H01F 27/42
(Continued)

(56) References Cited

U.S. PATENT DOCUMENTS 2,981,785 A * 4/1961 Plump ..... H01F 27/20 174/14 R
3,518,410 A 6/1970 Dillarstone
(Continued)

FOREIGN PATENT DOCUMENTS

CN 1392577 A 1/2003
CN 1822258 A 8/2006
(Continued)

OTHER PUBLICATIONS

First Office Action issued in corresponding Chinese application No. 201480080515.5, dated Apr. 3, 2018, 22 pp.
(Continued)

*Primary Examiner* — Tszfung J Chan
(74) *Attorney, Agent, or Firm* — Sage Patent Group

(57) ABSTRACT

The present invention relates to an electrical device comprising a gas-insulated transformer or reactor. The electrical device comprises a housing enclosing an interior space, at least a portion of which defining an insulation space containing a dielectric insulation fluid comprising an organofluorine compound, and an electrical component being arranged in the insulation space and being surrounded by the insulation fluid. The electrical component comprises at least one winding. The electrical device further comprises an electrical connector for bringing the apparatus from non-operational state to operational state by connecting at least one winding to a power grid. The device further comprises
(Continued)

Figure 1:
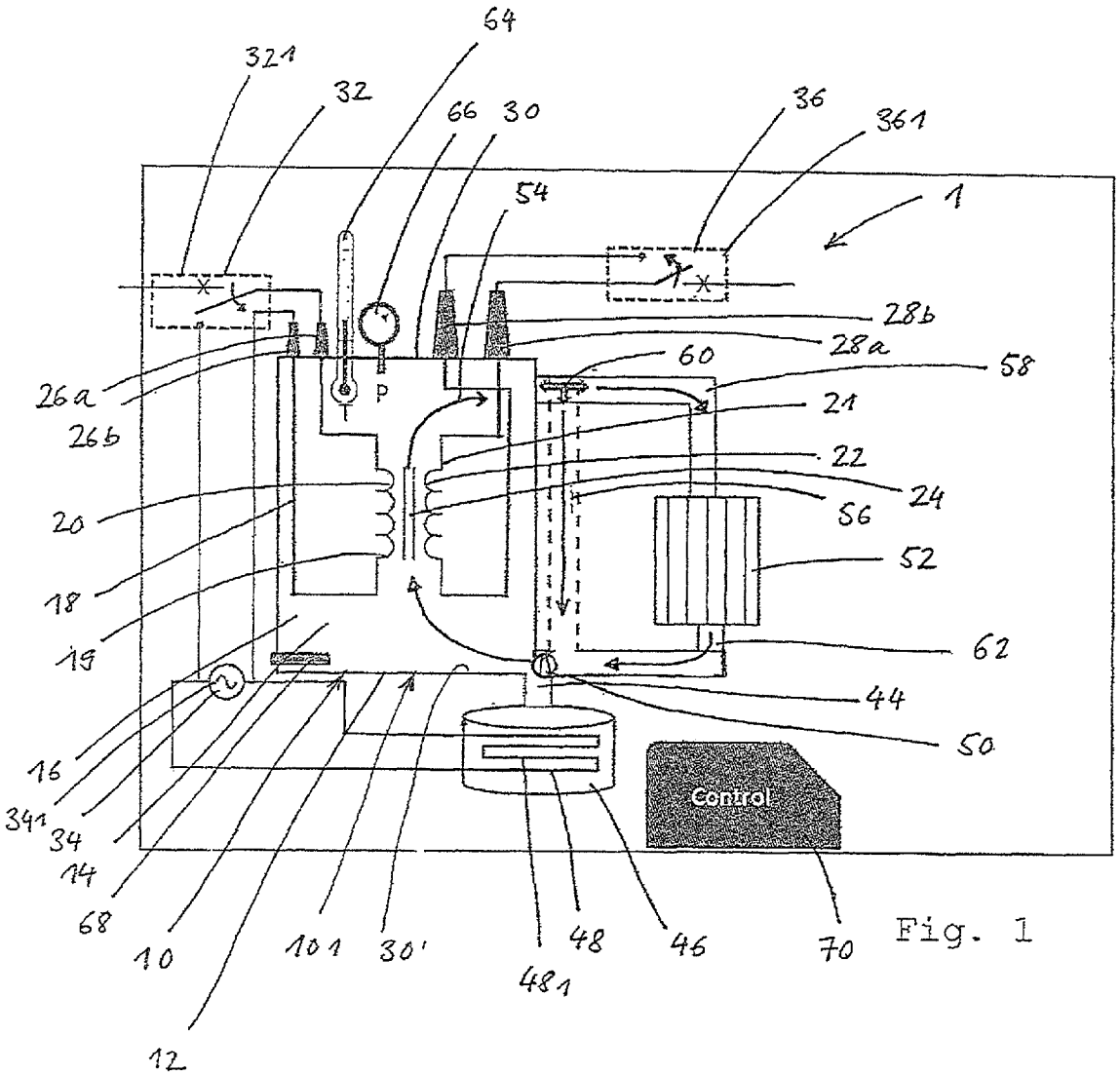

an auxiliary power source which is connectable to at least one winding when the apparatus is in the non-operational state.

26 Claims, 3 Drawing Sheets

(51) Int. Cl.
*H01F 27/20* (2006.01)
*H01F 27/40* (2006.01)
*H01F 27/42* (2006.01)

(58) Field of Classification Search
USPC ..... 336/55, 57, 58, 94
See application file for complete search history.

(56) References Cited

U.S. PATENT DOCUMENTS

| | | | | | |
|---|---|---|---|---|---|
| 4,485,367 | A | | 11/1984 | Hashizume | |
| 4,581,477 | A | | 4/1986 | Harumoto et al. | |
| 4,581,577 | A | | 4/1986 | Harumoto et al. | |
| 5,128,269 | A | * | 7/1992 | Oitate | G01R 31/1254 436/126 |
| 5,252,778 | A | * | 10/1993 | Ogawa | H01F 27/20 165/104.33 |
| 2003/0080841 | A1 | * | 5/2003 | Nishimizu | H01F 27/20 336/55 |
| 2009/0072940 | A1 | * | 3/2009 | Yang | H01F 27/14 336/57 |

FOREIGN PATENT DOCUMENTS

| | | | | | |
|---|---|---|---|---|---|
| CN | 1967955 | A | | 5/2007 | |
| CN | 201402708 | Y | | 2/2010 | |
| CN | 101840772 | A | | 9/2010 | |
| CN | 103268809 | A | | 8/2013 | |
| CN | 103904785 | A | | 7/2014 | |
| EP | 2284846 | A1 | | 2/2011 | |
| JP | S57-152111 | A | | 9/1982 | |
| JP | S58-60512 | A | | 4/1983 | |
| JP | S6010609 | A | | 1/1985 | |
| JP | 61180406 | A | * | 8/1986 | H01F 27/18 |
| JP | S61-180406 | A | | 8/1986 | |
| JP | H04-76276 | A | | 3/1992 | |
| JP | H11-135338 | A | | 5/1999 | |
| JP | 2014-506376 | A | | 3/2014 | |
| JP | 2014506375 | T2 | | 3/2014 | |
| WO | 2010138540 | A1 | | 12/2010 | |
| WO | 2011048039 | A2 | | 4/2011 | |
| WO | 2014/053661 | A1 | | 4/2014 | |

OTHER PUBLICATIONS

Notice of Grounds of Rejection issued in corresponding Japanese application No. 2017-500979, dated Jul. 17, 2018, 29 pp.
Notice of Grant issued in corresponding Japanese application No. 2017-500979, dated Jan. 29, 2019, 3 pp.
European Patent Office, International Search Report & Written Opinion issued in corresponding Application No. PCT/EP2014/064869, dated Apr. 13, 2015, 13 pp.

* cited by examiner

ELECTRICAL DEVICE COMPRISING A GAS-INSULATED APPARATUS, IN PARTICULAR A GAS-INSULATED TRANSFORMER OR REACTOR

The present invention relates to an electrical device, according to claim 1, as well as to a gas-insulated electrical apparatus according to claim 19, in particular a gas-insulated transformer or reactor.

Transformers and reactors are well known in the art. Generally, a transformer designates a device that transfers electrical energy from one circuit to another through inductively coupled conductors, i.e. the transformer windings. A current in the first ("primary") winding creates a magnetic field in a magnetic core, the magnetic field inducing a voltage in the second ("secondary") winding. This effect is called mutual induction.

A reactor within the meaning of the present invention designates an inductor used to block high-frequency alternating current in an electrical circuit, while allowing lower frequency or direct current to pass. In contrast to a transformer, which in any case comprises at least two windings, a reactor can comprise one single winding.

The active parts of the electrical component of the transformer or reactor, which among other parts comprises the winding(s) and the magnetic core, must be insulated from each other depending on the dielectric requirements between them. With regard to the insulation, different types of transformers (or reactors in analogy) can be distinguished:

In a dry transformer (or reactor, respectively) on the one hand, the electrical component comprising the windings and the magnetic core is not immersed in an insulating fluid; typically, it is surrounded by air at atmospheric pressure.

In a liquid- or gas-insulated transformer (or reactor, respectively) on the other hand, the electrical component is arranged in a tank or vessel which is filled with an insulation fluid. Specifically, in a liquid-insulated transformer the insulation fluid is a liquid, such as mineral oil or silicone oil or ester oil, or respectively in a gas-insulated transformer the insulation fluid is a gas, such as $SF_6$ or $N_2$ either at atmospheric or elevated pressure.

For a voltage higher than 36 kV, gas-insulated or liquid-insulated transformers (or reactors, respectively) are typically used. Due to the relatively high insulating performance and the high thermal performance of the insulation fluid, the clearance between the parts of the electrical component is relatively small.

However, liquid-insulated transformers, and in particular oil-immersed transformers, bear a risk of fire and explosion under severe fault conditions. This can be critical in sensitive areas, such as underground substations, urban areas, refineries and offshore-installations. In such cases, gas-insulated transformers filled with a non-flammable gas are preferably used for safety reasons. For example, transformers using $SF_6$ as insulation gas have become available on the market.

In the attempt of finding an alternative insulation fluid having a high insulation performance and having at the same time a low Global Warming Potential (GWP) lower than $SF_6$, the use of a fluoroketone in a transformer has been suggested e.g. in WO2011/048039.

Gas-insulated transformers need to be fully functional at ambient temperatures above the specified minimum temperature of operation, which can e.g. be as low as −25° C. In consequence, an insulation fluid is typically used which is in its gaseous state under operating conditions, i.e. down to the minimum operating temperature.

However, fluoroketones have a relatively high boiling point and thus bear the risk of condensation even at temperatures above the minimum operating temperatures. However, if the insulation medium is partially condensed, the dielectric withstand capability or dielectric strength of the electrical apparatus, specifically of the transformer or reactor, is reduced, meaning that it may not be energized to the full rated voltage.

In order to reduce the risk of condensation, a relatively low partial pressure of the fluoroketone is typically chosen, which again has an impact on the dielectric withstand capability and also on the cooling capability of the insulation fluid.

The risk of condensation is particularly apparent when the apparatus is in a non-operational state, i.e. before being connected to the power grid. In this state, there is no power loss and thus no heat generated; the temperature in the interior space might thus be insufficient for maintaining the insulation fluid in gaseous state.

In a cold environment, i.e. far below the dew point of the insulation fluid, condensation phenomena can even occur during operation, i.e. when heat generated by the power losses of the apparatus is insufficient for maintaining the temperature above the dew point. This is in particular the case when there is no load or only little load.

Considering the shortcomings of the state of the art, the problem to be solved by the present invention is thus to provide an electrical device comprising an electrical apparatus having a gas insulation, in particular a gas-insulated transformer or gas-insulated reactor, which makes use of an insulation fluid comprising an organofluorine compound, said device allowing to start operation of the apparatus to the full rated voltage in a very safe manner.

According to a further aspect, the present invention also aims at solving the problem of providing an electrical apparatus having a gas insulation, in particular a gas-insulated transformer or gas-insulated reactor, which makes use of an insulation fluid comprising an organofluorine compound, said device allowing for a very safe operation independent of the load conditions.

The problem is solved by the subject matter of independent claims 1 and 19, respectively. Preferred embodiments are given in the dependent claims and claim combinations.

According to claim 1, the present invention relates to an electrical device comprising an electrical apparatus having a gas insulation, in particular a gas-insulated transformer or gas-insulated reactor, comprising a housing enclosing a transformer interior space, at least a portion of which defining an insulation space containing a dielectric insulation fluid comprising an organofluorine compound. The electrical apparatus further comprises an electrical component arranged in the insulation space and being surrounded by the insulation fluid, said electrical component comprising at least one winding. According to the invention, the electrical device comprises an electrical connector for bringing the apparatus from a non-operational state to an operational state by connecting one or more of the at least one winding to a power grid. The electrical device further comprises an auxiliary power source which is connectable to one or more of the at least one winding when the electrical apparatus is in the non-operational state.

The term "winding" as used in the context of the present invention is to be interpreted broadly and, in particular, also encompasses a winding in the form of a voltage system which itself comprises two or more windings or coils.

The term "electrical apparatus having a gas insulation" shall broadly encompass any electrical apparatus having at least one component, part or compartment with gas insulation and shall also encompass any fully gas-insulated electrical apparatus.

The term "non-operational state" as used in the context of the present invention in particular relates to the state in which all windings are galvanically isolated from the power grid. Preferably, a combination of a circuit breaker and an isolator is used to keep the windings off-grid and to safely connect the respective winding to the auxiliary power source.

The term "reactor" as used in the context of the present invention in particular relates to an electrical reactor, more particularly for current limitation device and/or a reactive power compensation device.

By connecting one or more windings to the auxiliary power source, heat can be generated by power losses in particular before the electrical apparatus becomes operational, i.e. before it is connected to the power grid, i.e. in a starting phase of the electrical apparatus. This again allows condensed insulation fluid to be brought into the gaseous state and thus an insulation gas of the nominal composition and, consequently, of a sufficiently high dielectric strength to be achieved prior to starting operation of the electrical apparatus.

Specifically, the auxiliary power source is therefore designed such to generate heat in the at least one winding that is connected to the auxiliary power source. Thereby, the winding(s) function(s) as a heating element generating the amount of heat required for evaporating any condensate of the insulation fluid present in the insulation space. Thus there is no additional heating means required, which ultimately allows for achieving a very compact design of the apparatus. For the generation of heat, the present invention allows for using no-load losses, load losses, or both. In particular, an alternating-current (AC) power source or a direct-current (DC) power source can be used for the heating. An alternating power source is preferred, as will be discussed in more detail below. In particular, an alternating-current auxiliary power source can be chosen that has an electrical power rating comparable to rated load losses of the electrical apparatus.

However, if a direct power source is available, e.g. for powering secondary equipment of the electrical apparatus such as certain SCADA devices, heat can be generated by ohmic losses using this DC source only. It is further also possible to supply a high-frequency voltage to the windings whereby a magnetic field of the same high frequency will be created in the core. Herein, high frequency shall broadly encompass frequencies above power-grid frequency (i.e. above 50 Hz or above 60 Hz or above 16⅔ Hz) and may, in particular, encompass frequencies in the kHz-range or 10 kHz-range or 100 kHz-range or higher.

It is understood that apart from the electrical apparatus, the electrical connector and the auxiliary power source, the electrical device can comprises further individual components, e.g. an isolator.

As mentioned, the electrical apparatus having a gas insulation of the present invention is preferably a gas-insulated transformer or gas-insulated reactor. The invention thus makes use of the winding(s) that is or are inherent to a transformer or reactor by connecting them to a power source other than the power grid to duly prepare the transformer or reactor, and in particular its dielectric withstand, for the dielectric conditions present during the operational state.

According to an embodiment, the electrical apparatus is a gas-insulated transformer, specifically a gas-insulated power transformer. Consequently, the electrical component of this embodiment comprises at least two windings per phase, including a primary winding and a secondary winding per phase, and further comprises a magnetic core. Thereby, the electrical connector is designed for bringing the transformer from a non-operational state to an operational state, in particular a starting phase, by connecting the primary winding to the power grid.

In particular, the at least two windings comprise apart from the primary winding, here for example the winding to be connected with the main alternating power source, a secondary winding, here for example the winding to be connected with a load. In embodiments, further windings, for example a tertiary winding, a quaternary winding or other windings, can also be present.

In the embodiment of a gas-insulated transformer, the windings can be wound around the magnetic core, as it is the case in a "core-type" transformer, or can be surrounded by the magnetic core, as it is the case in a "shell-type" transformer.

In embodiments, the apparatus is a power transformer.

As discussed above, the auxiliary power source is in general designed such to generate heat in any winding connected to the auxiliary power source. As will be discussed in more detail below, the auxiliary power source can ideally also be used for supplying power to further components of the transformer, such as an additional heating element and/or a fan.

In embodiments, the electrical device further comprises means for short-circuiting at least one winding which is not to be connected to the auxiliary power source. In particular, when the electrical apparatus is off-grid and in particular when the electrical apparatus is separated on its secondary side from the grid, such means shall short-circuit at least a secondary winding or a primary winding which is or are not to be connected to the auxiliary power source.

In the embodiment mentioned above, in which the auxiliary power source is an auxiliary alternating power source, the power source is preferably rated such to induce a voltage in the winding, in particular primary winding, connected to the auxiliary alternating power source so that at most 200% of the rated current in the at least one short-circuited winding, in particular secondary winding, preferably at most 150%, and more preferably at most 100% of the rated current is generated. According to a preferred embodiment, the auxiliary alternating power source is rated such to induce a voltage in the winding connected to it so that at least approximately the rated current or less in the at least one short-circuited winding is generated.

In embodiments, the auxiliary power source is a direct-current (DC) power source, in particular for supplying power to secondary equipment of the electrical apparatus, for generating ohmic losses in the at least one winding, that is connected to the auxiliary power source, during the non-operational state, in particular a starting phase, of the electrical apparatus.

In embodiments, the auxiliary power source is a high-frequency power source. Specifically, the auxiliary power source is a high-frequency power source for generating high-frequency magnetic losses in the magnetic core of a gas-insulated transformer during the non-operational state, in particular a starting phase, of the gas-insulated transformer.

According to embodiments, the electrical connector is a switch for switching the at least one winding from being connected to the power grid to being connected to the auxiliary power source and, in particular, visa versa from being connected to the auxiliary power source to the power grid. This again contributes to a very compact design of the electrical device.

In embodiments, the electrical connector comprises a circuit breaker, in particular in combination with an isolator, for interrupting and keeping the electrical apparatus off-grid, in particular for interrupting and keeping interrupted the primary side of the electrical apparatus from the grid, and further comprises contact means for connecting at least one of the at least one windings to the auxiliary power source when the electrical apparatus is off-grid, in particular when the electrical apparatus is separated on its primary side from the grid.

According to a specific embodiment, the auxiliary power source is designed for further supplying power to at least one fan and/or to at least one additional thermal element attributed to the electrical apparatus. In this context, the additional thermal element refers to a thermal element other the one formed by the windings connected to the auxiliary power source. The fan and the additional thermal element(s) allow a homogenous heat distribution within the interior space of the apparatus. By using the same power supply for these components and for the windings functioning as a thermal element, a very compact design can be achieved.

As mentioned, the present invention further relates to a gas-insulated apparatus, in particular for use in an electrical device as described above.

The electrical apparatus includes a gas insulation and comprises a radiator for transferring heat from the interior space to the outside of the apparatus. By means of the radiator, excess heat generated during operation of the apparatus can thus be efficiently emitted. The radiator is designed to be passed through by a heat transfer fluid carrying heat generated in any of the windings and/or in a magnetic core (if present) of the electrical apparatus, the flow of the heat transfer fluid defining a heat transfer fluid path.

According to the invention, the apparatus further comprises a bypass channel for the heat transfer fluid which upstream of the radiator branches off from the heat transfer fluid path, such that at least a portion of the heat transfer fluid is allowed to bypass the radiator.

Typically, the heat transfer fluid and the insulation fluid are one and the same. Specifically, it is a heat transfer gas.

The heat transfer fluid path can at least partly be in the form of a channel, in particular a channel enclosed by channel walls.

In complete generality, i.e. in the context of this application or independent therefrom for electrical medium-voltage or high-voltage apparatuses in general, the radiator can be designed to transfer heat to the environment, or the heat emitted by the radiator can further be used for heating further electrical devices or apparatuses using an insulation fluid and/or an arc extinction medium containing for example an organofluorine compound as disclosed herein or any other $SF_6$-substituting dielectric insulation fluid and/or arc extinction medium. In particular, the heat can be used for a gas-insulated switchgear or a component thereof which uses an alternative gas different from $SF_6$ and, in particular, uses also the insulation fluid and/or the arc extinction medium mentioned herein. For this purpose, respective channels, in particular in the form of pipes or tubes, can be arranged on the outside of the housing for transferring heat received from the radiator to the further electrical device, in particular the GIS.

As mentioned above, the electrical apparatus of the present invention is preferably a gas-insulated transformer or gas-insulated reactor, in particular a gas-insulated transformer, more particularly a gas-insulated power transformer.

In embodiments, downstream of the branching off of the bypass channel the heat transfer fluid path forms a radiator inlet channel and at the branching off of the bypass channel, a valve, in particular a three-port valve, is arranged for at least partially opening and closing the bypass channel and the radiator inlet channel, respectively. Thus, the flow of the heat transfer fluid can be controlled and the amount of heat transfer fluid to pass and/or to bypass the radiator can be adapted to the actual temperature situation in the transformer interior space. If, on the one hand, heat is required for bringing condensate into the gaseous phase or to counteract a temperature drop that might lead to condensation, the amount of heat transfer fluid to bypass the radiator is increased. If, on the other hand, excess heat is generated also in consideration of the heat needed for maintaining the insulation fluid in fully gaseous state, said excess heat can be emitted by directing the respective amount of heat transfer fluid to pass the radiator.

It is further preferred that directly adjacent to and downstream of the radiator (with downstream being defined by the flow direction of the heat transfer fluid) the heat transfer fluid path forms a radiator outlet channel, the bypass channel opening into the radiator outlet channel at a distance from the radiator. Thus, the portion of the heat transfer fluid directed through the bypass channel again enters the heat transfer fluid path and thus the circulation of the transfer fluid. Due to the fact that heat carried by the bypassing heat transfer fluid is not emitted in the radiator, a relatively high amount of heat energy is thereby brought into the circulation contributing in maintaining a relative high temperature in the transformer interior space.

Depending on the temperature situation in the insulation space, it may be particularly preferred that a fan is arranged for generating a flow of the heat transfer fluid, in particular a flow from the heat transfer fluid bypass channel and/or from the radiator outlet channel into the insulation space, and/or for homogenously mixing the fluid components contained in the heat transfer fluid.

The fan, apart from its function to cool the transformer by convection, also serves to homogenously mix the insulation fluid, thus allowing to achieve a homogenous insulation fluid composition and a homogenous heat distribution throughout the whole insulation space. This is of particular relevance when using an insulation fluid component of a relatively high specific weight, such as a fluoroketone, in combination with a background gas, such as $CO_2$ and/or $O_2$, since an accumulation of fluoroketone in the bottom region, which might occur without constant mixing, can efficiently be avoided by the fan. The fan generates a flow of the heat transfer fluid which flow, depending on the temperature situation, is allowed to pass and/or to bypass the radiator.

If a fan is provided, multiple different cooling modes can be achieved. According to a first mode, the fan is non-active and the bypass channel is open, thereby providing minimal cooling. Cooling can be increased by activating the fan or by at least partially closing the bypass channel, thereby increasing the amount of heat transfer fluid to pass the radiator. Maximum cooling can be obtained by activating the fan and at the same time closing the bypass channel.

During the procedure of heating up the electrical apparatus, the bypass channel is typically at least partially open. Preferably, the fan is in operation during this procedure, thereby generating a flow of heat transfer fluid that is at least partially passing the bypass channel.

The term "fan" as used in the context of the present invention is to be interpreted broadly and encompasses any device for generating a gas flow and in particular encompasses a ventilator, a blower or a pump.

According to an embodiment, the apparatus further comprises a collecting tank for collecting condensate of the insulation fluid. It is preferred that the apparatus further comprises an additional thermal element for vaporizing condensate, in particular condensate contained in the collecting tank. By collecting the condensed insulation fluid in the collecting tank, very efficient vaporization can be achieved by transferring heat energy specifically to the collecting tank, particularly to its walls.

Preferably, the additional thermal element and/or the fan are connected to the auxiliary power source for power supply. Alternatively or additionally, it is also possible to feed the additional thermal element and/or the fan by means of thermal energy, e.g. by using geothermal energy or distributed heating.

According to an embodiment, the organofluorine compound is selected from the group consisting of: fluoroethers, in particular hydrofluoromonoethers, fluoroketones, fluoroolefins, in particular hydrofluoroolefins, and mixtures thereof, since these classes of compounds have been found to have very high insulation capabilities, in particular a high dielectric strength (or breakdown field strength) and at the same time a low GWP and low toxicity.

The invention encompasses both embodiments in which the respective insulation fluid comprises either one of a fluoroether, in particular a hydrofluoromonoether, a fluoroketone and a fluoroolefin, in particular a hydrofluoroolefin, as well as embodiments in which it comprises a mixture of at least two of these compounds.

In embodiments, the insulation fluid further comprises a background gas, in particular selected from the group consisting of air, an air component, nitrogen, oxygen, carbon dioxide, a nitrogen oxide and mixtures thereof.

The term "fluoroether" as used in the context of the present invention encompasses both perfluoroethers, i.e. fully fluorinated ethers, and hydrofluoroethers, i.e. ethers that are only partially fluorinated. The term "fluoroether" further encompasses saturated compounds as well as unsaturated compounds, i.e. compounds including double and/or triple bonds between carbon atoms. The at least partially fluorinated alkyl chains attached to the oxygen atom of the fluoroether can, independently of each other, be linear or branched.

The term "fluoroether" further encompasses both non-cyclic and cyclic ethers. Thus, the two alkyl chains attached to the oxygen atom can optionally form a ring. In particular, the term encompasses fluorooxiranes. In a specific embodiment, the organofluorine compound according to the present invention is a perfluorooxirane or a hydrofluorooxirane, more specifically a perfluorooxirane or hydrofluorooxirane comprising from three to fifteen carbon atoms.

In embodiments, the respective insulation fluid comprises a hydrofluoromonoether containing at least three carbon atoms. Apart from their high dielectric strength, these hydrofluoromonoethers are chemically and thermally stable up to temperatures above 140° C. They are non-toxic or have a low toxicity level. In addition, they are non-corrosive and non-explosive.

The term "hydrofluoromonoether" as used herein refers to a compound having one and only one ether group, said ether group linking two alkyl groups, which can be, independently from each other, linear or branched, and which can optionally form a ring. The compound is thus in clear contrast to the compounds disclosed in e.g. U.S. Pat. No. 7,128,133, which relates to the use of compounds containing two ether groups, i.e. hydrofluorodiethers, in heat-transfer fluids.

The term "hydrofluoromonoether" as used herein is further to be understood such that the monoether is partially hydrogenated and partially fluorinated. It is further to be understood such that it may comprise a mixture of differently structured hydrofluoromonoethers. The term "structurally different" shall broadly encompass any difference in sum formula or structural formula of the hydrofluoromonoether.

As mentioned above, hydrofluoromonoethers containing at least three carbon atoms have been found to have a relatively high dielectric strength. In particular, the ratio of the dielectric strength of the hydrofluoromonoethers according to the present invention to the dielectric strength of $SF_6$ is greater than about 0.4.

As also mentioned, the GWP of the hydrofluoromonoethers is low. Preferably, the GWP is less than 1,000 over 100 years, more specifically less than 700 over 100 years. The hydrofluoromonoethers mentioned herein have a relatively low atmospheric lifetime and in addition are devoid of halogen atoms that play a role in the ozone destruction catalytic cycle, namely Cl, Br or I. The Ozone Depletion Potential (ODP) of hydrofluoromonoethers mentioned herein is zero, which is very favourable from an environmental perspective.

The preference for a hydrofluoromonoether containing at least three carbon atoms and thus having a relatively high boiling point of more than −20° C. is based on the finding that a higher boiling point of the hydrofluoromonoether generally goes along with a higher dielectric strength.

According to other embodiments, the hydrofluoromonoether contains exactly three or four or five or six carbon atoms, in particular exactly three or four carbon atoms, most preferably exactly three carbon atoms.

More particularly, the hydrofluoromonoether is thus at least one compound selected from the group consisting of the compounds defined by the following structural formulae in which a part of the hydrogen atoms is each substituted by a fluorine atom:

(Oa)

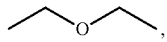

(Ob)

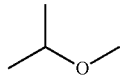

(Oc)

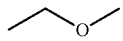

(Od)

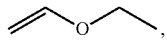

(Oe)

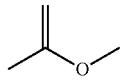

(Of)

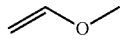

(Og)

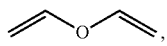

(Oh)

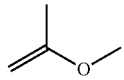

-continued (Oi)

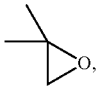

(Oj)

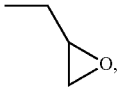

(Ok)

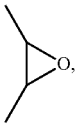

(Ol)

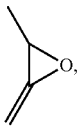

(Om)

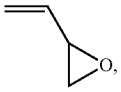

(On)

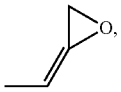

(Oo)

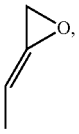

(Op)

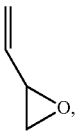

(Oq)

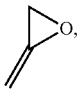

(Or)

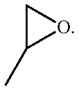

By using a hydrofluoromonoether containing three or four carbon atoms, vaporization can be achieved by moderate heating of the windings of the apparatus. Thus, an insulation fluid, every component of which is in the gaseous state prior to operation of the apparatus, can be achieved.

Considering flammability of the compounds, it is further advantageous that the ratio of the number of fluorine atoms to the total number of fluorine and hydrogen atoms, here briefly called "F-rate", of the hydrofluoromonoether can be chosen to be at least 5:8. It has been found that compounds falling within this definition are generally non-flammable and thus result in an insulation fluid complying with highest safety requirements.

According to other embodiments, the ratio of the number of fluorine atoms to the number of carbon atoms, here briefly called "F/C-ratio", ranges from 1.5:1 to 2:1. Such compounds generally have a GWP of less than 1,000 over 100 years and are thus very environment-friendly. It is particularly preferred that the hydrofluoromonoether has a GWP of less than 700 over 100 years.

According to other embodiments of the present invention, the hydrofluoromonoether has the general structure (O)

$$C_aH_bF_c—O—C_dH_eF_f \quad (O)$$

wherein a and d independently are an integer from 1 to 3 with a+d=3 or 4 or 5 or 6, in particular 3 or 4, b and c independently are an integer from 0 to 11, in particular 0 to 7, with b+c=2a+1, and e and f independently are an integer from 0 to 11, in particular 0 to 7, with e+f=2d+1, with further at least one of b and e being 1 or greater and at least one of c and f being 1 or greater.

It is thereby a preferred embodiment that in the general structure or formula (O) of the hydrofluoromonoether: a is 1, b and c independently are an integer ranging from 0 to 3 with b+c=3, d=2, e and f independently are an integer ranging from 0 to 5 with e+f=5, with further at least one of b and e being 1 or greater and at least one of c and f being 1 or greater.

According to a more particular embodiment, exactly one of c and f in the general structure (O) is 0. The corresponding grouping of fluorines on one side of the ether linkage, with the other side remaining unsubstituted, is called "segregation". Segregation has been found to reduce the boiling point compared to unsegregated compounds of the same chain length.

Most preferably, the hydrofluoromonoether is selected from the group consisting of pentafluoro-ethyl-methyl ether ($CH_3$—O—$CF_2CF_3$) and 2,2,2-trifluoroethyl-trifluoromethyl ether ($CF_3$—O—$CH_2CF_3$). Pentafluoro-ethyl-methyl ether has a boiling point of +5.25° C. and a GWP of 697 over 100 years, the F-rate being 0.625, while 2,2,2-trifluoroethyl-trifluoromethyl ether has a boiling point of +11° C. and a GWP of 487 over 100 years, the F-rate being 0.75. They both have an ODP of 0 and are thus environmentally fully acceptable.

In addition, pentafluoro-ethyl-methyl ether has been found to be thermally stable at a temperature of 175° C. for 30 days and therefore to be fully suitable for the operational conditions given in the apparatus. Since thermal stability studies of hydrofluoromonoethers of higher molecular weight have shown that ethers containing fully hydrogenated methyl or ethyl groups have a lower thermal stability compared to those having partially hydrogenated groups, it can be assumed that the thermal stability of 2,2,2-trifluoro-ethyl-trifluoromethyl ether is even higher.

Hydrofluoromonoethers in general, and pentafluoro-ethyl-methyl ether as well as 2,2,2-trifluoroethyl-trifluoromethyl ether in particular, display a low risk of human toxicity. This can be concluded from the available results of mammalian HFC (hydrofluorocarbon) tests. Also, information available on commercial hydrofluoromonoethers do not give any evidence of carcinogenicity, mutagenicity, reproductive/developmental effects and other chronic effects of the compounds of the present application.

Based on the data available for commercial hydrofluoro ethers of higher molecular weight, it can be concluded that the hydrofluoromonoethers, and in particular pentafluoro-ethyl-methyl ether as well as 2,2,2-trifluoroethyl-trifluoromethyl ether, have a lethal concentration LC 50 of higher than 10,000 ppm, rendering them suitable also from a toxicological point of view.

The hydrofluoromonoethers mentioned have a higher dielectric strength than air. In particular, pentafluoro-ethyl-methyl ether at 1 bar has a dielectric strength about 2.4 times higher than that of air at 1 bar.

Given its boiling point, which is preferably below 55° C., more preferably below 40° C., in particular below 30° C., the hydrofluoromonoethers mentioned, particularly pentafluoro-ethyl-methyl ether and 2,2,2-trifluoroethyl-trifluoromethyl ether, respectively, are normally in the gaseous state at operational conditions. Also, an insulation fluid in which every component is in the gaseous state prior to operation of the apparatus can be achieved, which is advantageous.

Alternatively or additionally to the hydrofluoromonoethers mentioned above, the respective insulation fluid comprises a fluoroketone containing from four to twelve carbon atoms.

The term "fluoroketone" as used in this application shall be interpreted broadly and shall encompass both perfluoroketones and hydrofluoroketones, and shall further encompass both saturated compounds and unsaturated compounds, i.e. compounds including double and/or triple bonds between carbon atoms. The at least partially fluorinated alkyl chain of the fluoroketones can be linear or branched, or can form a ring, which optionally is substituted by one or more alkyl groups. In exemplary embodiments, the fluoroketone is a perfluoroketone. In further exemplary embodiment, the fluoroketone has a branched alkyl chain, in particular an at least partially fluorinated alkyl chain. In still further exemplary embodiments, the fluoroketone is a fully saturated compound.

According to another aspect, the insulation fluid according to the present invention can comprise a fluoroketone having from 4 to 12 carbon atoms, the at least partially fluorinated alkyl chain of the fluoroketone forming a ring, which is optionally substituted by one or more alkyl groups.

It is particularly preferred that the insulation fluid comprises a fluoroketone containing exactly five or exactly six carbon atoms or mixtures thereof. Compared to fluoroketones having a greater chain length with more than six carbon atoms, fluoroketones containing five or six carbon atoms have the advantage of a relatively low boiling point, allowing to efficiently counteract liquefaction by the device and the apparatus of the present invention.

According to embodiments, the fluoroketone is at least one compound selected from the group consisting of the compounds defined by the following structural formulae in which at least one hydrogen atom is substituted with a fluorine atom:

(Ia)

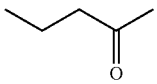

(Ib)

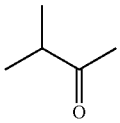

(Ic)

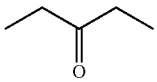

(Id)

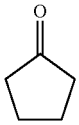

-continued (Ie)

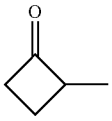

(If)

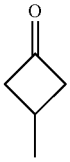

(Ig)

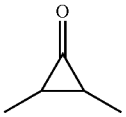

(Ih)

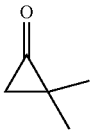

(Ii)

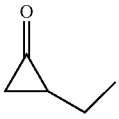

Fluoroketones containing five or more carbon atoms are further advantageous, because they are generally non-toxic with outstanding margins for human safety. This is in contrast to fluoroketones having less than four carbon atoms, such as hexafluoroacetone (or hexafluoropropanone), which are toxic and very reactive. In particular, fluoroketones containing exactly five carbon atoms, herein briefly named fluoroketones a), and fluoroketones containing exactly six carbon atoms are thermally stable up to 500° C.

According to a specific embodiment, the dielectric insulation fluid, in particular comprising a fluoroketone having exactly 5 carbon atoms and more particularly having a structural formula according to (Ia) to (Ii), can further comprise a background gas, in particular selected from the group consisting of: air, air component, nitrogen, oxygen, carbon dioxide, a nitrogen oxide (including but not limited to $NO_2$, NO, $N_2O$), and mixtures thereof.

In embodiments of this invention, the fluoroketones, in particular fluoroketones a), having a branched alkyl chain are preferred, because their boiling points are lower than the boiling points of the corresponding compounds (i.e. compounds with same molecular formula) having a straight alkyl chain.

According to embodiments, the fluoroketone a) is a perfluoroketone, in particular has the molecular formula $C_5F_{10}O$, i.e. is fully saturated without double or triple bonds between carbon atoms. The fluoroketone a) may more preferably be selected from the group consisting of 1,1,1,3,4,4,4-heptafluoro-3-(trifluoromethyl)butan-2-one (also named decafluoro-2-methylbutan-3-one), 1,1,1,3,3,4,4,5,5,5-decafluoropentan-2-one, 1,1,1,2,2,4,4,5,5,5-decafluoropentan-3-one and octafluorocylcopentanone, and most preferably is 1,1,1,3,4,4,4-heptafluoro-3-(trifluoromethyl)butan-2-one.

1,1,1,3,4,4,4-heptafluoro-3-(trifluoromethyl)butan-2-one can be represented by the following structural formula (I):

(I)

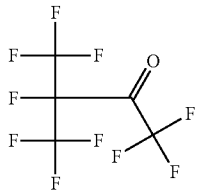

1,1,1,3,4,4,4-heptafluoro-3-(trifluoromethyl)butan-2-one, here briefly called "C5-ketone", with molecular formula $CF_3C(O)CF(CF_3)_2$ or $C_5F_{10}O$, has been found to be particularly preferred for high and medium voltage insulation applications, because it has the advantages of high dielectric insulation performance, in particular in mixtures with a dielectric carrier gas, has very low GWP and has a low boiling point. It has an ODP of 0 and is practically non-toxic.

According to embodiments, even higher insulation capabilities can be achieved by combining the mixture of different fluoroketone components. In embodiments, a fluoroketone containing exactly five carbon atoms, as described above and here briefly called fluoroketone a), and a fluoroketone containing exactly six carbon atoms or exactly seven carbon atoms, here briefly named fluoroketone c), can favourably be part of the dielectric insulation at the same time. Thus, an insulation fluid can be achieved having more than one fluoroketone, each contributing by itself to the dielectric strength of the insulation fluid.

In embodiments, the further fluoroketone c) is at least one compound selected from the group consisting of the compounds defined by the following structural formulae in which at least one hydrogen atom is substituted with a fluorine atom:

(IIa)

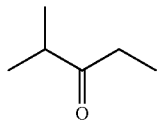

(IIb)

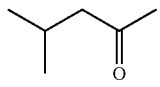

(IIc)

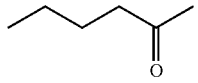

(IId)

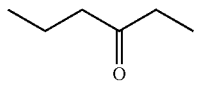

(IIe)

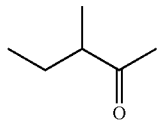

(IIf)

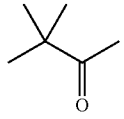

and

-continued (IIg)

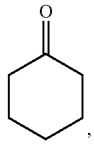

as well as any fluoroketone having exactly 6 carbon atoms, in which the at least partially fluorinated alkyl chain of the fluoroketone forms a ring, which is substituted by one or more alkyl groups (IIh);

and/or is at least one compound selected from the group consisting of the compounds defined by the following structural formulae in which at least one hydrogen atom is substituted with a fluorine atom:

(IIIa)

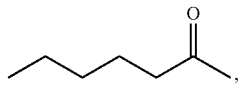

(IIIb)

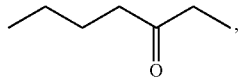

(IIIc)

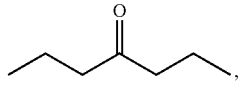

(IIId)

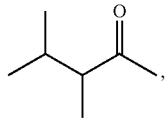

(IIIe)

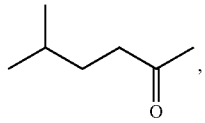

(IIIf)

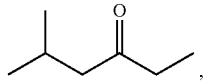

(IIIg)

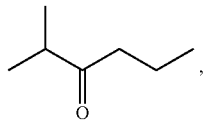

(IIIh)

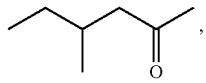

(IIIi)

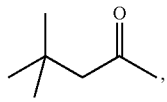

(IIIj)

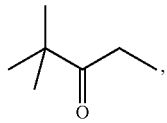

-continued (IIIk)

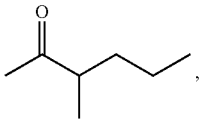

(IIIl)

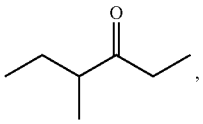

(IIIm)

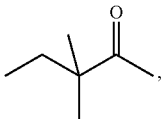

and (IIIn)

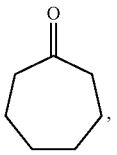

in particular dodecafluoro-cycloheptanone, as well as any fluoroketone having exactly 7 carbon atoms, in which the at least partially fluorinated alkyl chain of the fluoroketone forms a ring, which is substituted by one or more alkyl groups (IIIo).

The present invention encompasses each compound or each combination of compounds selected from the group consisting of the compounds according to structural formulae (Oa) to (Or), (Ia) to (Ii), (IIa) to (IIh), (IIIa) to (IIIo), and mixtures thereof.

According to another aspect, the dielectric insulation fluid according to the present invention can comprise a fluoroketone having exactly 6 carbon atoms, in which the at least partially fluorinated alkyl chain of the fluoroketone forms a ring, optionally substituted by one or more alkyl groups. Furthermore, such dielectric insulation fluid can comprise a background gas, in particular selected from the group consisting of: air, air component, nitrogen, oxygen, carbon dioxide, a nitrogen oxide (including but not limited to $NO_2$, NO, $N_2O$), and mixtures thereof. Furthermore, an electrical apparatus comprising such a dielectric insulation fluid is disclosed.

According to still another aspect, the insulation fluid can comprise a fluoroketone having exactly 7 carbon atoms, in which the at least partially fluorinated alkyl chain of the fluoroketone forms a ring, optionally substituted by one or more alkyl groups. Furthermore, such insulation fluid can comprise a background gas, in particular selected from the group consisting of: air, air component, nitrogen, oxygen, carbon dioxide, a nitrogen oxide (including but not limited to $NO_2$, NO, $N_2O$), and mixtures thereof. Furthermore, an electrical apparatus comprising such an insulation fluid is disclosed.

The present invention encompasses any insulation fluid comprising each compound or each combination of compounds selected from the group consisting of the compounds according to structural formulae (Oa) to (Or), (Ia) to (Ii), (IIa) to (IIg), (IIIc) to (IIIn), and mixtures thereof, and with the insulation fluid further comprising a background gas, in particular selected from the group consisting of: air, air component, nitrogen, oxygen, carbon dioxide, a nitrogen oxide (including but not limited to $NO_2$, NO, $N_2O$), and mixtures thereof. Furthermore, an electrical apparatus comprising such an insulation fluid is disclosed.

Depending on the specific application of the device and apparatus according to the present invention, a fluoroketone containing exactly six carbon atoms (falling under the designation "fluoroketone c)" mentioned above) may be preferred for the respective insulation space compartment; such a fluoroketone is non-toxic with outstanding margins for human safety.

In embodiments, fluoroketone c), alike fluoroketone a), is a perfluoroketone, and/or has a branched alkyl chain, in particular an at least partially fluorinated alkyl chain, and/or the fluoroketone c) contains fully saturated compounds. In particular, the fluoroketone c) has the molecular formula $C_6F_{12}O$, i.e. is fully saturated without double or triple bonds between carbon atoms. More preferably, the fluoroketone c) can be selected from the group consisting of 1,1,1,2,4,4,5,5,5-nonafluoro-2-(trifluoromethyl)pentan-3-one (also named dodecafluoro-2-methylpentan-3-one), 1,1,1,3,3,4,5,5,5-nonafluoro-4-(trifluoromethyl)pentan-2-one (also named dodecafluoro-4-methylpentan-2-one), 1,1,1,3,4,4,5,5,5-nonafluoro-3-(trifluoromethyl)pentan-2-one (also named dodecafluoro-3-methylpentan-2-one), 1,1,1,4,4,4-hexafluoro-3,3-bis-(trifluoromethyl)butan-2-one (also named dodecafluoro-3,3-(dimethyl)butan-2-one), dodecafluorohexan-2-one, dodecafluorohexan-3-one and decafluorocyclohexanone (with sum formula $C_6F_{10}O$), and particularly is the mentioned 1,1,1,2,4,4,5,5,5-nonafluoro-2-(trifluoromethyl)pentan-3-one.

1,1,1,2,4,4,5,5,5-Nonafluoro-2-(trifluoromethyl)pentan-3-one (also named dodecafluoro-2-methylpentan-3-one) can be represented by the following structural formula (II):

(II)

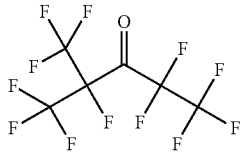

1,1,1,2,4,4,5,5,5-Nonafluoro-4-(trifluoromethyl)pentan-3-one (here briefly called "C6-ketone", with molecular formula $C_2F_5C(O)CF(CF_3)_2$) has been found to be particularly preferred for high voltage insulation applications because of its high insulating properties and its extremely low GWP. Specifically, its pressure-reduced breakdown field strength is around 240 kV/(cm*bar), which is much higher than the one of air having a much lower dielectric strength ($E_{cr}$=25 kV/(cm*bar)). It has an ozone depletion potential of 0 and is non-toxic. Thus, the environmental impact is much lower than when using $SF_6$, and at the same time outstanding margins for human safety are achieved.

As mentioned above, the organofluorine compound can also be a fluoroolefin, in particular a hydrofluoroolefin. More particularly, the fluoroolefin or hydrofluorolefin, respectively, contains exactly three carbon atoms.

According to an embodiment, the hydrofluoroolefin is thus selected from the group consisting of: 1,1,1,2-tetrafluoropropene (HFO-1234yf), 1,2,3,3-tetrafluoro-2-propene (HFO-1234yc), 1,1,3,3-tetrafluoro-2-propene (HFO-1234zc), 1,1,1,3-tetrafluoro-2-propene (HFO-1234ze), 1,1,2,3-tetrafluoro-2-propene (HFO-1234ye), 1,1,1,2,3-pentafluoropropene (HFO-1225ye), 1,1,2,3,3-pentafluoropropene (HFO-1225yc), 1,1,1,3,3-pentafluoropropene (HFO- 1225zc), (Z)1,1,1,3-tetrafluoropropene (HFO-1234zeZ), (Z)1,1,2,3-tetrafluoro-2-propene (HFO-1234yeZ), (E)1,1,1,3-tetrafluoropropene (HFO-1234zeE), (E)1,1,2,3-tetrafluoro-2-propene (HFO-1234yeE), (Z)1,1,1,2,3-pentafluoropropene (HFO-1225yeZ), (E)1,1,1,2,3-pentafluoropropene (HFO-1225yeE) and combinations thereof.

Figure 2:
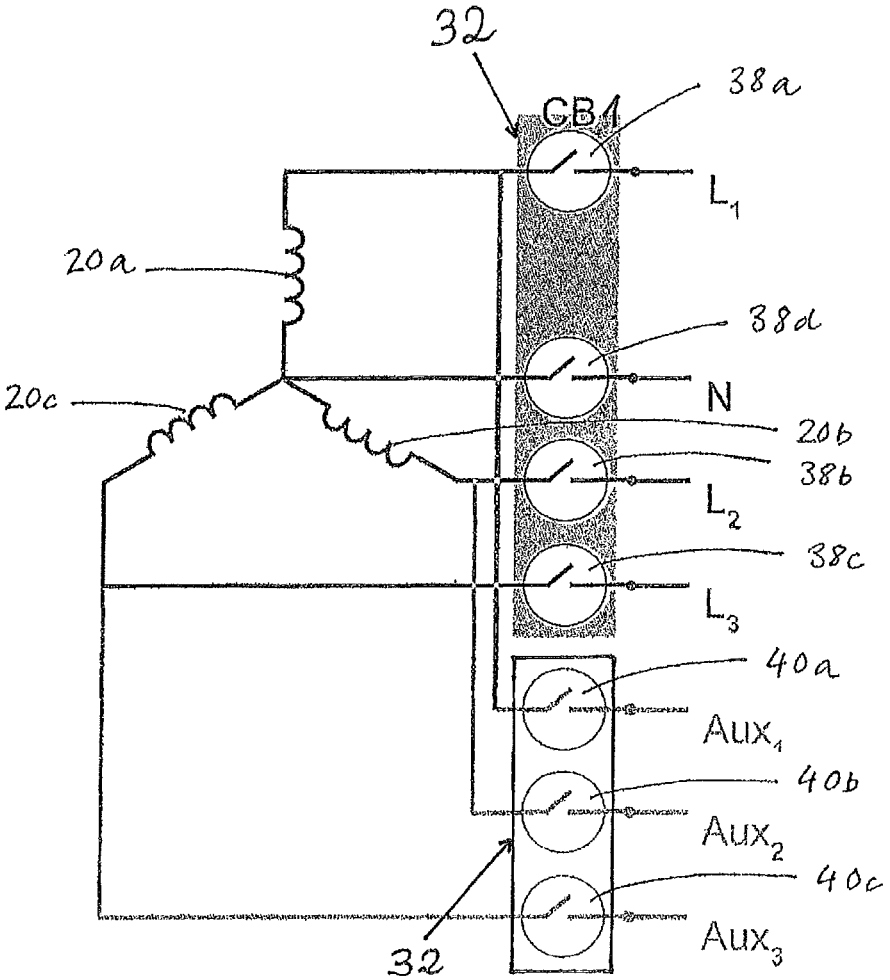
Figure 3:
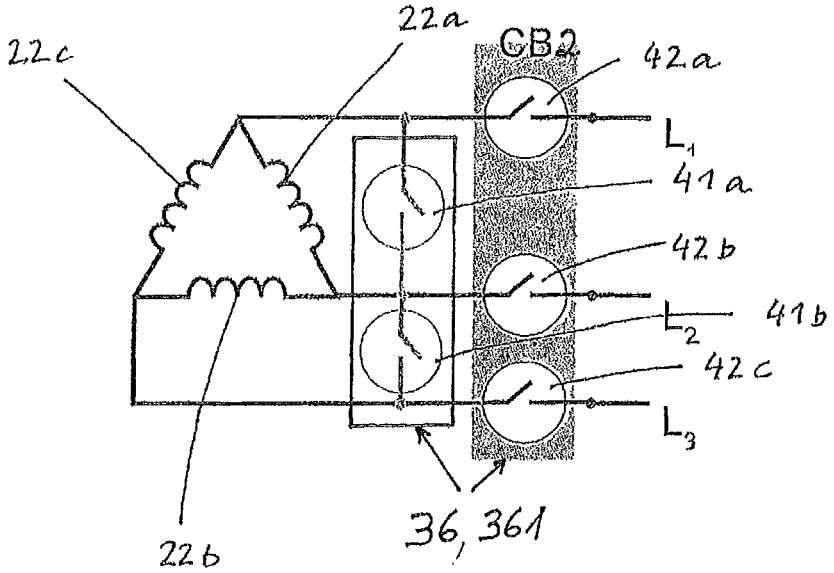

The present invention is further illustrated by way of the attached figures, which show in:

FIG. 1 a purely schematic illustration of an exemplary electrical device of the present invention comprising an inventive gas-insulated transformer;

FIG. 2 a switching configuration of a primary side of a transformer of the exemplary device according to the present invention; and FIG. 3 a switching configuration of a secondary side of a transformer of the exemplary device according to the present invention.

According to FIG. 1, the exemplary electrical device 1 comprises an electrical apparatus 10 including a gas insulation, in the specific embodiment being shown a gas-insulated transformer 101. The transformer 101 comprises a housing 12 enclosing an interior space 14. The interior space 14 defines an insulation space 16 containing a dielectric insulation fluid comprising an organofluorine compound.

In the insulation space 16, an electrical component 18 is arranged and surrounded by the insulation fluid. The electrical component 18 comprises a first winding 20, i.e. the primary winding 20, formed of a first conductor 19, and a second winding 22, i.e. the secondary winding 22, formed of a second conductor 21, both of which are arranged around a magnetic core 24 in the embodiment shown. For both the first conductor 19 and the second conductor 21, respective bushings 26*a*, 26*b* and 28*a*, 28*b*, respectively, are arranged in the wall 30 of the housing 12.

The device 1 further comprises an electrical connector 32 for bringing the transformer 101 from a non-operational state to an operational state. According to the embodiment shown, this is achieved by the electrical connector 32 connecting the primary winding 20 to the power grid.

The device 1 further comprises an auxiliary power source 34 which is connectable to the primary winding 20 when the transformer 101 is in the non-operational state, i.e. when the transformer 101 is galvanically isolated from the power grid. In the embodiment shown, the auxiliary power source 34 is an alternating power source and the electrical connector 32 is an electrical switch 321 for switching the primary winding 20 from being connected to the power grid to being connected to the auxiliary power source 34.

According to the embodiment shown, the electrical device 1 comprises means 36, in particular a switch 361, for short-circuiting the secondary winding 22. As disclosed in FIG. 3 in conjunction with FIG. 1, the means 36; 361; 41*a*, 41*b*; 42*a*, 42*b*, 42*c* for short-circuiting can comprise a circuit breaker CB2, 42*a*, 42*b*, 42*c* for interrupting and keeping the electrical apparatus 10 off-grid, in particular for interrupting the electrical apparatus 10 on its secondary side and keeping it interrupted on its secondary side from the grid.

An exemplary switching configuration of the primary side (here supply side) of the transformer 101 is shown in FIG. 2, while a specific configuration of the secondary side (here load side) is shown in FIG. 3. According to the specific embodiment, the transformer 101 is thus a three-phase power transformer 101 employing star-connected windings 20*a*, 20*b*, 20*c* on the primary side and delta-connected windings on the secondary side, the wires of the respective phase being abbreviated with L1, L2, L3 with the neutral wire of the star configuration being abbreviated with N.

In the non-operational state shown, the contacts 38*a*, 38*b*, 38*c*, 38*d* in the circuit breaker CB1, or first three-phase circuit breaker CB1, attributed to the primary side are open and the transformer 101 is thus galvanically isolated from the power grid. In this state, the primary windings 20*a*, 20*b*, 20*c* can be connected to the auxiliary power source 34 by closing the respective contacts 40*a*, 40*b*, 40*c*, the corresponding wires being abbreviated by $Aux_1$, $Aux_2$ and $Aux_3$.

On the secondary side, the windings 22*a*, 22*b*, 22*b* can be short-circuited by means of the respective contacts 41*a*, 41*b* when the contacts 42*a*, 42*b*, 42*c* in the respective circuit breaker CB2, or second three-phase circuit breaker CB2, are open. Thus, the means 36; 361; 41*a*, 41*b*; 42*a*, 42*b*, 42*c* for short-circuiting can comprise a circuit breaker CB2, 42*a*, 42*b*, 42*c* for interrupting and keeping the electrical apparatus 10 off-grid, in particular for interrupting the electrical apparatus 10 on its secondary side and keeping it interrupted on its secondary side from the grid. Thereby, the contacts 41*a*, 41*b* function as shortcircuiting contacts between windings 20 or 22, here between secondary windings 22*a*, 22*b*, 22*c*.

By the auxiliary alternating power source 34, a voltage can be induced in the windings 20*a*, 20*b*, 20*c* of the primary side to generate at least approximately the rated current in the windings 22*a*, 22*b*, 22*c* of the secondary side, ultimately allowing for an efficient heating of the insulation space 16 by power losses and thus for maintaining the insulation fluid, and in particular the organofluorine compound contained therein, in the gaseous phase.

In exemplary embodiments, a sink 44 is arranged in the bottom wall 30' of the housing shown in FIG. 1, which sink 44 opens into a collecting tank 46. The sink 44 and the collecting tank 46 are designed for collecting condensate of the insulation fluid. To the collecting tank 46, an additional thermal element 48 in the form of a heat coil 481 is attached for vaporizing condensate contained in the collecting tank 46. The additional thermal element 48 is connected to the auxiliary power source 34 for power supply.

In exemplary embodiments, the transformer 101 can further comprise a fan 50 which in the embodiment shown is arranged in the bottom region of the housing 12. Like the auxiliary power thermal element 48, also the fan 50 can for example be connected to the auxiliary power source 34 for power supply.

The transformer 101 can further comprise a radiator 52 which is connected to the housing 12 in a distance from the electrical component 18. The radiator 52 is designed to be passed by a heat transfer fluid carrying heat generated in any of windings 20, 22 and/or the core 24, and to thereby transfer heat from the interior space 14 to the outside of the transformer 101.

The flow of the heat transfer fluid defines a heat transfer fluid path 54, which is only schematically shown in FIG. 1 by means of arrows.

The electrical apparatus 10 can further comprise a bypass channel 56 for the heat transfer fluid which upstream of the radiator 52 branches off from the heat transfer fluid path 54, such that at least a portion of the heat transfer fluid is allowed to bypass the radiator 52.

Downstream of the branching off of the bypass channel 56, the heat transfer fluid path 54 forms a radiator inlet channel 58, which opens into the radiator 52. At the branching off of the bypass channel 56, a valve 60, specifically a three-port valve 60, can be arranged for at least partially opening and closing the bypass channel 56 and the radiator inlet channel 58, respectively.

Directly adjacent to and downstream from the radiator 52, i.e. in direction of the downstreaming heat transfer fluid, the heat transfer fluid path 54 forms a radiator outlet channel 62, into which the bypass channel 56 opens at a distance from the radiator 52.

By means of the fan 50, a flow of the heat transfer fluid, specifically from the bypass channel 56 and/or the radiator outlet channel 62 in particular into the insulation space 16, can be generated.

The transformer 101 further comprises a temperature sensor 64, specifically a thermometer, a pressure and/or gas density sensor 66, specifically a manometer, and a chemical sensor 68, specifically a chromatographic sensor or an optical sensor, more specifically a UV sensor. By means of these sensors, the actual conditions in the insulation space 16 can be determined. In particular, the gas composition or gas density can be determined and compared to the nominal composition and/or nominal density.

For example prior to operation of the transformer 101, i.e. in a starting phase in which the windings 20, 22 are still galvanically isolated from the power grid, the primary winding 20 is connected to the auxiliary power source 34 and the secondary winding is short-circuited. In the embodiment shown, the auxiliary power source 34 is an auxiliary alternating-current power source 341 that is rated such to induce in the primary winding 20 the voltage required for generating at most 100% of the rated current in the secondary winding 22. Due to the power losses, the windings 20, 22 are heated, thus effecting a temperature increase in the insulation space 16 allowing condensed insulation fluid to be brought in the gaseous state. Ultimately, an insulation gas of the nominal composition and, consequently, of a sufficiently high dielectric strength can thus be achieved prior to starting operation of the transformer 101.

In other words, the auxiliary power source 34 is designed such to generate heat for evaporating the dielectric insulation fluid at least partially or fully to increase the dielectric strength of the gas phase of the dielectric insulation fluid above an operational threshold dielectric strength value of the electrical apparatus 10.

Thus, preferably the windings 20, 22 of the transformer 101 act as a heating element generating the amount of heat required for evaporating any condensate of the insulation fluid present in the insulation space 16 prior to operation.

During operation, a constant flow of heat transfer fluid is generated by means of the fan 50 described above, thus ensuring that the transformer 101 is constantly cooled. The fan 50 also serves to permanently mix the insulation fluid, in order to obtain a homogenous insulation fluid composition and heat distribution throughout the whole insulation space 16.

By means of the above mentioned sensors 64, 66, 68, the conditions in the insulation space 16, in particular the temperature, the pressure as well as the composition and density of the insulation fluid, can be constantly monitored.

If for example the temperature measured and/or a comparison of the partial pressure of organofluorine compound to the nominal value reveals that there is need for liquid organofluorine compound to be brought in the gaseous phase, this can be achieved by means of the valve 60 controlling the amount of heat transfer fluid bypassing the radiator 52. Specifically, the amount of heat transfer fluid to bypass the radiator 52 is increased.

If, on the other hand, the temperature measured reveals that excess heat is generated also in consideration of the heat needed for maintaining the insulation fluid in fully gaseous state, said excess heat can be emitted by directing the respective amount of heat transfer fluid to pass the radiator 52. For this purpose, the bypass channel 56 can be closed.

For controlling electrical operation of the transformer 101 and/or the composition of the insulation fluid, the transformer comprises a control device 70, which allows controlling for example the mode of the fan 50 and the degree to which the bypass channel is opened, for example by controlling the mode of the valve 60.

LIST OF REFERENCE NUMERALS

1 electrical device
10, 101 electrical apparatus; transformer
12 housing
14 interior space
16 insulation space
18 electrical component
19 first wire
20 first (primary) winding
21 second wire
22 second (secondary) winding
24 magnetic core
26*a*, 26*b* bushing for first wire
28*a*, 28*b* bushing for second wire
30, 30' housing wall; bottom wall of housing
32 electrical connector
321 electrical switch
34; 341 auxiliary power source; auxiliary alternating power source
36, 361 means for short-circuiting secondary winding; switch
38*a*-38*d* contacts in circuit breaker (primary side)
40*a*-40*c* contacts for connecting windings (primary side) to auxiliary power source
41*a*, 41*b* contacts for short-circuiting windings (secondary side)
42*a*-42*c* contacts in circuit breaker (secondary side)
44 sink
46 collecting tank
48, 481 additional thermal element, heat coil
50 fan
52 radiator
54 heat transfer fluid path
56 bypass channel
58 radiator inlet channel
60 valve
62 radiator outlet channel
64 temperature sensor
66 pressure and/or gas density sensor
68 chemical sensor
70 control device

The invention claimed is:

1. An electrical device comprising an electrical apparatus including a gas insulation, the electrical apparatus is one of a gas-insulated transformer or gas-insulated reactor, comprising a housing enclosing an interior space, at least a portion of which interior space defining an insulation space containing a dielectric insulation fluid comprising an organofluorine compound, and an electrical component being arranged in the insulation space and being surrounded by the insulation fluid, said electrical component comprising at least one winding, the electrical device further comprising an electrical connector for bringing the electrical apparatus from a non-operational state to an operational state by connecting one or more of the at least one winding to a power grid, wherein the device further comprises an auxiliary power source which is connectable to one or more of the at least one winding when the electrical apparatus is in the non-operational state, wherein the auxiliary power source is an auxiliary alternating-current power source, and wherein the auxiliary alternating-current power source has an electrical power rating comparable to rated load losses of the electrical apparatus.

2. The electrical device according to claim 1, wherein the electrical apparatus is a gas-insulated transformer, specifically a gas insulated power transformer, the electrical component of which comprising at least two windings per phase, including a primary winding and a secondary winding per phase, and further comprising a magnetic core, and the electrical connector operable for bringing the transformer from a non-operational state to an operational state by connecting the primary winding to the power grid.

3. The electrical device according to claim 1, wherein the auxiliary power source is designed such to generate heat in the at least one winding that is connected to the auxiliary power source, during the non-operational state of the electrical apparatus.

4. The electrical device according to any one claim 1, wherein the auxiliary power source is operable to generate heat for evaporating the dielectric insulation fluid at least partially to increase the dielectric strength of the gas phase of the dielectric insulation fluid above an operational threshold dielectric strength value of the electrical apparatus.

5. The electrical device according to claim 1, which further comprises means for short-circuiting at least one winding, which is not to be connected to the auxiliary power source, when the electrical apparatus is off-grid.

6. The electrical device according to claim 5, wherein the means for short-circuiting comprise a circuit breaker for interrupting and keeping the electrical apparatus off-grid.

7. The electrical device according to claim 1, wherein the auxiliary alternating power source is rated such to induce a voltage in the at least one winding connected to the auxiliary alternating power source so that at most 200% of the rated current in the at least one short-circuited winding is generated.

8. The electrical device according to claim 1, wherein the auxiliary power source is a direct-current (DC) power source, in particular for supplying power to secondary equipment of the electrical apparatus, for generating ohmic losses in the at least one winding, that is connected to the auxiliary power source, during the non-operational state of the electrical apparatus.

9. The electrical device according to claim 1, wherein the auxiliary power source is a high-frequency power source.

10. The electrical device according to claim 2, wherein the auxiliary power source is a high-frequency power source for generating high-frequency magnetic losses in the magnetic core of the gas-insulated transformer during the non-operational state of the gas-insulated transformer.

11. The electrical device according to claim 1, wherein the electrical connector is an electrical switch for switching the at least one winding from being connected to the power grid to being connected to the auxiliary power source.

12. The electrical device according to claim 1, wherein the electrical connector comprises a circuit breaker, for interrupting and keeping the electrical apparatus off-grid, in particular for interrupting and keeping interrupted the primary side of the electrical apparatus from the grid, and further comprises contact means for connecting at least one of the at least one windings to the auxiliary power source when the electrical apparatus is off-grid, in particular when the electrical apparatus is separated on its primary side from the grid.

13. The electrical device according to claim 1, wherein the auxiliary power source is operable for further supplying power to at least one fan and/or to at least one additional thermal element attributed to the electrical apparatus.

14. The electrical device according to claim 1, wherein the organofluorine compound is selected from the group consisting of: fluoroethers, fluoroketones, fluoroolefins and mixtures thereof.

15. The electrical device (1) according to claim 1, wherein the insulation fluid comprises a hydrofluoromonoether containing at least three carbon atoms.

16. The electrical device according to claim 1, wherein the insulation fluid comprises a fluoroketone containing from four to twelve carbon atoms.

17. The electrical device according to claim 1, wherein the insulation fluid further comprises a background gas, the background gas selected from the group consisting of air, an air component, nitrogen, oxygen, carbon dioxide, a nitrogen oxide, and mixtures thereof.

18. An electrical apparatus including a gas insulation for use in an electrical device according to claim 1, the apparatus comprising a radiator for transferring heat from the interior space to the outside of the electrical apparatus, the radiator being designed to be passed by a heat transfer fluid carrying heat generated in any of at least one winding of the electrical apparatus and/or in a magnetic core of the electrical apparatus, the flow of the heat transfer fluid defining a heat transfer fluid path, wherein the electrical apparatus further comprises a bypass channel for the heat transfer fluid which upstream of the radiator branches off from the heat transfer fluid path, such that at least a portion of the heat transfer fluid is allowed to bypass the radiator.

19. The electrical apparatus according to claim 18, wherein the electrical apparatus is one of a gas-insulated transformer or gas-insulated reactor.

20. The electrical apparatus according to claim 18, wherein downstream of the branching off the bypass channel the heat transfer fluid path forms a radiator inlet channel, and at the branching off of the bypass channel a valve is arranged for at least partially opening and closing the bypass channel and the radiator inlet channel, respectively.

21. The electrical apparatus according to claim 18, wherein directly adjacent to and downstream of the radiator the heat transfer fluid path forms a radiator outlet channel, the bypass channel opening into the radiator outlet channel at a distance from the radiator.

22. The electrical apparatus according to claim 18, further comprising a fan for generating a flow of the heat transfer fluid, in particular a flow from the bypass channel and/or from the radiator outlet channel into the insulation space, and/or for homogenously mixing the fluid components contained in the heat transfer fluid.

23. The electrical apparatus a to claim 18, further comprising a collecting tank for collecting condensate of the insulation fluid.

24. The electrical apparatus according to claim 18, further comprising an additional thermal element for vaporizing condensate.

25. The electrical apparatus according to claim 22, wherein the additional thermal element and/or the fan is or are connected to the auxiliary power source for power supply.

26. The electrical apparatus according to claim 18, further comprising at least one control device for controlling electrical operation of the electrical apparatus and/or of the composition of the insulation fluid.

* * * * *